US006742525B2

(12) United States Patent
Sinclair, Jr.

(10) Patent No.: US 6,742,525 B2
(45) Date of Patent: Jun. 1, 2004

(54) TOBACCO PRODUCT

(75) Inventor: Daniel S. Sinclair, Jr., Mandeville, LA (US)

(73) Assignee: Blunt Wrap U.S.A., Inc., Mandeville, LA (US)

( * ) Notice: Subject to any disclaimer, the term of this patent is extended or adjusted under 35 U.S.C. 154(b) by 0 days.

(21) Appl. No.: 10/083,671

(22) Filed: Feb. 26, 2002

(65) Prior Publication Data

US 2002/0166561 A1 Nov. 14, 2002

Related U.S. Application Data

(60) Continuation-in-part of application No. 09/944,979, filed on Aug. 31, 2001, now Pat. No. 6,357,448, which is a division of application No. 09/456,738, filed on Dec. 7, 1999, now Pat. No. 6,321,755.

(60) Provisional application No. 60/357,511, filed on Feb. 15, 2002, and provisional application No. 60/318,976, filed on Sep. 13, 2001.

(51) Int. Cl.[7] ..... A23C 5/00

(52) U.S. Cl. ..... 131/365; 131/360; 131/73; 131/77; 131/58

(58) Field of Search ..... 131/73, 77, 280, 131/75, 105, 365, 58, 70, 328, 360

(56) References Cited

U.S. PATENT DOCUMENTS

| | | | | |
|---|---|---|---|---|
| 191,501 A | | 5/1877 | Willis | 131/73 |
| 200,889 A | | 3/1878 | Bishop | 131/77 |
| 304,582 A | | 9/1884 | Thoss | |
| 389,975 A | | 9/1888 | Riedel | 131/73 |
| 657,403 A | | 8/1900 | Du Brul | |
| 663,073 A | | 12/1900 | Coughtry | |
| 725,671 A | | 4/1903 | Butler | |
| 1,104,779 A | | 7/1914 | Cooley | |
| 1,223,362 A | | 4/1917 | Bock | |
| 3,385,302 A | | 5/1968 | Wattenford | |
| 4,452,257 A | * | 6/1984 | Cartwright et al. | 131/310 |
| 5,147,463 A | * | 9/1992 | Eilerman et al. | 131/277 |
| 5,645,089 A | | 7/1997 | Burger et al. | 131/365 |
| 5,762,074 A | | 6/1998 | Garner | 131/360 |
| 5,782,246 A | | 7/1998 | Axelrod | 131/364 |
| 6,164,443 A | | 12/2000 | Mitchell et al. | 206/242 |
| 6,321,755 B1 | | 11/2001 | Sinclair, Jr. | 131/73 |
| 6,357,448 B1 | | 3/2002 | Sinclair, Jr. | 131/365 |

FOREIGN PATENT DOCUMENTS

| | | | |
|---|---|---|---|
| DE | 352277 | 4/1922 | 131/73 |
| GB | 1230576 | 5/1971 | |

OTHER PUBLICATIONS

Aug. 8, 2002 Declaration Under 37 CFR Section 1.132 of Daniel Sinclair, Jr. (disclosing prior art flavored tobacco products and first sale of invention disclosed in U.S. patent Nos. 6,321,755 and 6,357,448).

* cited by examiner

*Primary Examiner*—Dionne A. Walls
(74) *Attorney, Agent, or Firm*—Garvey, Smith, Nehrbass & Doody, L.L.C.; Seth M. Nehrbass; Charles C. Garvey, Jr.

(57) ABSTRACT

A tobacco product is formed by rolling a sheet of material supplied by a roll or rolls (e.g. moistened tobacco leaves) and/or homogenized sheet tobacco about a slit mandrel to form a shaped tube. The shaped tube is then packaged for shipment to an end user or consumer. The shaped tube remains in the rolled, shaped tube form inside the package. After the shaped tube is removed from the package, a consumer can fill the tube with crushed tobacco leaves or other tobacco filler material of a favorite blend, thereby eliminating some steps in the making of a "roll-your-own" tobacco product. A liquid can be added to the sheet or to the finished tube to moisturize same. The liquid can include flavoring. The tubes are unfilled when packaged and sent to a consumer/end user in tube form so that they have a "memory" that helps hold a tubular cigar shape after they are filled with selected tobacco fill material.

44 Claims, 11 Drawing Sheets

TOBACCO PRODUCT

CROSS-REFERENCE TO RELATED APPLICATIONS

This is a continuation-in-part of my U.S. patent application Ser. No. 09/944,979, filed Aug. 31, 2001, and entitled "Method of Making a Tobacco Product", (now U.S. Pat. No. 6,357,448) which is a divisional of U.S. patent application Ser. No. 09/456,738, filed Dec. 7, 1999 (now U.S. Pat. No. 6,321,755), both of which are incorporated herein by reference.

Also incorporated herein by reference is my U.S. Provisional Patent Application Serial No. 60/357,511, filed Feb. 15, 2002. Priority of this application is hereby claimed.

Also incorporated herein by reference is my U.S. Provisional Patent Application Serial No. 60/318,976, filed Sep. 13, 2001. Priority of this application is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The present invention relates to tobacco products, and more particularly to a cigar shell or tube that enables an end user or consumer to prepare a custom cigar.

The variety, quality and size of ready-made cigars satisfy the majority of the public.

However, a small segment of connoisseurs insist that nothing can compare with the taste and smell of custom-blended tobacco products. These knowledgeable individuals are very selective in the manner their cigars are rolled and in the grade of tobacco used.

A still smaller segment of cigar aficionados prefers to roll their own cigars. They buy tobacco leaves or cigar wrappings and use their preferred brand of crushed tobacco. Some people buy inexpensive cigars, cut them with a sharp blade along the side and carefully pry the cut cigar open. The innermost layers are then removed and substituted with a favorite brand of crushed tobacco, which may come from cigarettes or bulk tobacco blend. The user then brings the cut edges of the cigar together, closing the outer layers of the cigar over the "stuffing." The edges are then sealed with a liquid or honey, and a new cigar is ready for smoking.

Some reports indicate that the roll-your-own tobacco market is flourishing. In some countries, the roll-your-own products now hold a substantial share of the tobacco market, and their consumers represent more than 10% of the smoking population. This may be explained by the ability of a consumer to create a tailor-made product, as opposed to commercially available types of cigars.

A disadvantage of the existing method of making such custom-made cigars is that a consumer has to be skillful in the rolling of cigars, that is to have a certain finger dexterity, which would allow him to make the cigar shell without crushing the tobacco leaves. Inexperienced people often become frustrated when the finished product collapses because the cigar was not properly rolled.

The present invention contemplates provision of a hollow tobacco tube or shell that enables an end user or consumer to fabricate a custom-made cigar. The present invention discloses a method of making the shell and a packaged tobacco product that enables a consumer or end user to add his or her own tobacco in the making of a custom cigar.

SUMMARY

The present invention provides an improved shell for fabricating and making custom made rolls of tobacco such as cigars, and a method of making such shells that includes preferably tobacco, preferably tobacco leaves. The sheet of material is then moistened with a liquid. The sheet of material is then rolled into a tube shaped shell or tube that has a longitudinal bore, a slit for adding material to the bore, and a pair of edges that can be moved apart so that tobacco fill material can be added to the bore via the slit. As part of the method, the shaped tube is packaged for sale to a consumer without filling the tube bore with tobacco fill material. In other words, the tube shaped shell can be completely empty or partially filled. A consumer or end user can construct a cigar that is unique and personal by enabling the end user to add her own favorite tobacco to the tube or shell bore.

The method of the present invention thus enables an end user that purchases the packaged, shaped tubes to make his or her own cigars with a selected, custom tobacco filler material. The method preferably includes the use of a liquid that includes flavor or flavoring. The liquid can be, in whole or in part, water, alcohol, solvent, oil, propylene glycol, ethyl alcohol, glycerin, benzyl alcohol as examples.

The liquid can be flavored with a flavor such as for example vanilla, honey, berry, chocolate, peach, champagne, cognac, and/or menthol.

As an alternate method, the cigar can be constructed by providing a sheet of material that includes tobacco, rolling the sheet of material into a shaped tube that has a longitudinal bore, a slit for adding material to the bore, and a pair of edges that can be moved apart so that the tobacco fill material can be added to the bore via the slit. The shaped tube can then be moistened with a liquid. The shaped tube is then packaged for sale to a consumer without filling the tube bore with tobacco fill material, thus enabling an end user to make a custom cigar by filling the shaped tube with selected fill material.

It is an object of the present invention to provide a device for making a tobacco shell.

It is another object of the invention to provide a method of making a shell suitable for use in rolling a custom-made cigar.

It is a further object of the present invention to provide a method of making a shell for a custom-rolled cigar.

These and other objects of the invention are achieved through a provision of a shell that eliminates some steps in the making of a "roll-your-own" tobacco product. In another method, wrapping moistened tobacco leaves around a cylindrical form casing forms the shell. The leaves are then allowed to dry, and the shell is ready for sale to consumers. After the form casing is removed, the consumer can fill the shell with a favorite blend of tobacco.

With the method of the present invention, the tube that is formed preferably has a generally cylindrical shape. With the alternate method, the sheet of material can be single or multiple layered and comprised entirely of tobacco leaves, or can be a combination of tobacco leaves and other material, which are preferably combustible material(s).

The sheet of material preferably includes a plurality of edges and two of the edges are brought together to define a slit there between that communicates with the bore to which a selected tobacco filler material can be added by the consumer/end user.

The method can provide the step of packaging a plurality of the shaped tubes for sale to consumers without filling the tubes with the tobacco fill material. This embodiment provides a shaped tube of generally cylindrically shape and enables a consumer to remove one of the tubes at a time from the packaging, fill it with a selected tobacco fill material, and then form a cigar for smoking.

Another method of constructing a cigar includes the steps of: 1) providing a sheet of material that includes at least in part, tobacco; 2) rolling that sheet of material into a shaped tube that has a longitudinal bore, a slit for adding material to the bore, and edges that can be moved apart so that tobacco fill material can be added to the bore via the slit; 3) moistening the shaped tube with liquid; and 4) the shaped tube can be packaged for sale to consumers and without filling the tube bore with a tobacco fill material. The liquid can be added to the tube after it is shaped.

The present invention provides yet another method of constructing a cigar that includes the steps of: 1) providing a flexible sheet of material that includes tobacco leaves; 2) rolling that flexible sheet of material into an unfilled, shaped tube that has a longitudinal bore, a longitudinal slit for adding material to the bore, and a pair of edges that can be moved apart so that tobacco fill material can be added to the bore via the slit; 3) moistening the tube with liquid; 4) packaging the shaped tube for sale to consumers without filling the shaped tube bore with tobacco fill material as it is packaged. The shaped, packaged unfilled tube can then be distributed to consumer/end users as part of the method.

The flavors are preferably added to either the shaped tube (or the sheet of material that includes tobacco) with a liquid. This flavored liquid is typically applied to the tobacco sheet or to the shaped tube at levels of between about 0.01 to 45% by weight, and preferably between about 0.1% to 10% by weight.

This flavored liquid is typically applied to the sheet of material that includes tobacco (or to the shaped tube) with a carrier liquid such as ethyl alcohol, propylene glycol, water or the like. Glycerin and invert sugar can also be used as a carrier. Some humectants can also be used, however, little or no humectants can be used.

In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils.

An object is to provide a tobacco product comprising: (a) a first layer of material; (b) a second layer of material in contact with the first layer of material; (c) the first and second layers of material having a memory wherein the layers tend to curve; (d) the first and second layers forming a cylinder with a bore and having opposed edge portions that can be separated apart to open the bore; (e) the bore being less than about twenty five percent filled with a tobacco filler product; and (f) the cylinder being packaged.

Another object is to provide a tobacco product comprising: (a) a layer of material having a memory wherein the layer tends to curve; (b) the layer forming a cylinder having a longitudinal bore and a plurality of edge portions; (c) the bore being less than about twenty five percent filled with a tobacco filler product; and (d) the cylinder being packaged.

Another object is to provide a tobacco product comprising: (a) a sheet of material having a memory wherein the sheet tends to curve; (b) the sheet forming a generally cylindrical spiral with spaced apart edges; and (c) the cylindrical spiral being packaged.

Another object is to provide a tobacco product comprising: (a) a sheet having a memory wherein the sheet tends to curve; (b) the sheet being in the shape of a parallelogram before curving; (c) the sheet forming a longitudinal spiral tube after curving having a tube volume, the tube volume being less than about twenty five percent filled with a tobacco filler product; and (d) the longitudinal spiral tube being packaged.

Another object is to provide a tobacco product comprising: (a) a first sheet; (b) a second sheet in contact with the first sheet; (c) the first sheet having a memory wherein the sheet tends to roll up; (d) the first and second sheets forming a longitudinal spiral tube having a tube volume; and (e) the longitudinal spiral tube being packaged with less than about twenty five percent filling of a tobacco fill material in the tube volume.

Another object is to provide a tobacco product comprising: (a) a first sheet; (b) a second sheet in contact with at least a portion of the first sheet; (c) at least the first sheet having a memory wherein the sheet tends to roll up; (d) the first and second sheets forming a cylinder having a bore and a plurality of edge portions; (e) the cylinder being unfilled with a tobacco filler product; and (f) the unfilled cylinder being packaged.

Another object is to provide a device for preparing a tobacco product, comprising: a hollow shell having a central opening extending longitudinally therethrough, said shell being formed from rolled tobacco leaves, and a package enclosing said shell.

Another object is to provide a shell for a tobacco product, comprising: (a) a removable substantially cylindrical form casing; and (b) a shell body having a central opening extending longitudinally therethrough, said shell body being wrapped about said form casing, said shell body comprising tobacco leaves.

Another object is to provide a tobacco product comprising: (a) a first sheet; (b) a second sheet in contact with at least a portion of the first sheet; (c) at least the first sheet having a memory wherein the sheet tends to roll up; (d) the first and second sheets forming a cylinder having a plurality of edge portions; (e) the cylinder being less than about twenty five percent filled with a tobacco filler product; and (f) the cylinder being packaged.

Another object is to provide a tobacco shell product, comprising: (a) a sheet of tobacco-containing material; (b) a longitudinal bore defined when the sheet is formed into a hollow tube; and (c) the longitudinal bore being less than about twenty five percent filled with a tobacco fill product; and (d) a package of such dimensions to maintain the sheet in the formed configuration until the sheet and tube are removed from the package to fill with tobacco material.

Another object is to provide a tobacco shell product, comprising: (a) a sheet of tobacco-containing material; (b) a tube for receiving the material there around; (c) a longitudinal bore formed in the material when the sheet is wrapped around the tube; and (d) a package of such dimensions for receiving the wrapped material wherein the package maintains the sheet in the wrapped configuration until the sheet and tube are removed from the package to fill with a tobacco fill material.

Another object is to provide a fabricated cigar product, comprising: (a) a shell of material containing in part tobacco; (b) a tube for wrapping the shell of material there around to define a cigar shape; and (c) a wrapper, of such dimensions, for receiving the wrapped shell, and upon removal of the tube, walls of the wrapper maintaining the shell in the cigar shape until the tube is removed from the package to fill with tobacco.

Another object is to provide a shell for assembling custom-made rolls of tobacco for smoking, comprising (a) a sheet of combustible material which is at least partially coiled at rest and which has not been part of a previously assembled cigar or cigarette; (b) the sheet of material having at least two edges and a surface area located between the edges; (c) the surface area having an inner surface and an outer surface, and (d) wherein an edge of the sheet of material at rest extends along and adjacent to part of a surface of the sheet of material; and (e) the edges being separable, providing access to the inner surface of the sheet of material for depositing thereon tobacco products to be smoked.

Another object is to provide a shell for assembling custom-made rolls of tobacco for smoking, comprising: (a) a sheet of combustible material which has not been part of a previously assembled cigar or cigarette; (b) said sheet of material having at least two edges and a surface area located between said edges; (c) said area having an inner surface and an outer surface; (d) wherein the sheet is at least partially coiled at rest; and (e) said edges being separable to provide access to the inner surface of the sheet of material for depositing thereon tobacco products to be smoked in the shell.

Another object is to provide an apparatus including a pre-formed cigar rolling wrapper product comprising: (a) a coiled sheet of combustible material which can be uncoiled enough to add shredded tobacco therein, the coiled sheet not being formed by cutting open a pre-formed cigar and removing tobacco therefrom, and the coiled sheet having an outer edge being affixable against the coiled sheet after tobacco is added therein to form a cigar; and (b) a hollow package for holding the unfilled coiled sheet.

Another object is to provide a bore which is less than about fifty percent filled with a tobacco filler product, preferably less than about twenty five percent filled, and most preferably unfilled. The percent of volume of a bore filled should be calculated based on an uncompacted tobacco filler product being used to fill the bore volume.

Another object is to provide a tube volume which is less than about fifty percent filled with a tobacco filler product, preferably less than about twenty five percent filled, and most preferably unfilled. The percent of volume of tube volume filled should be calculated based on an uncompacted tobacco filler product being used to fill the tube volume.

BRIEF DESCRIPTION OF THE DRAWINGS

Reference will now be made to the drawings, wherein like parts are designated by like numerals, and wherein.

DETAILED DESCRIPTION OF AT LEAST ONE PREFERRED EMBODIMENT

Figure 2:
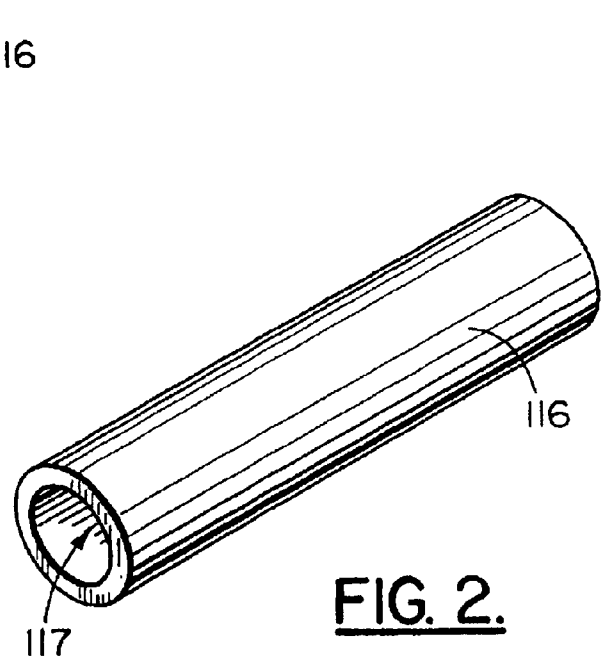
FIG. 2 is a perspective view of a form casing for use in the method of the present invention.
Figure 1:
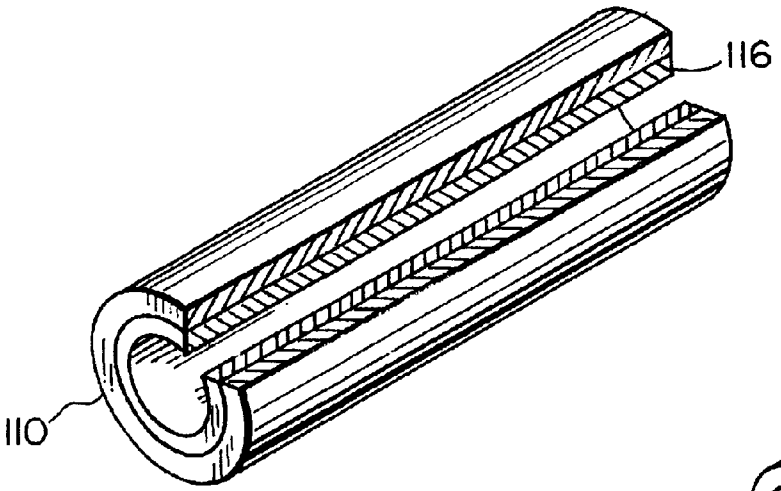
FIG. 1 is a perspective, partially cross-sectional view of a shell in accordance with the present invention wrapped about a form casing.
Figure 3:
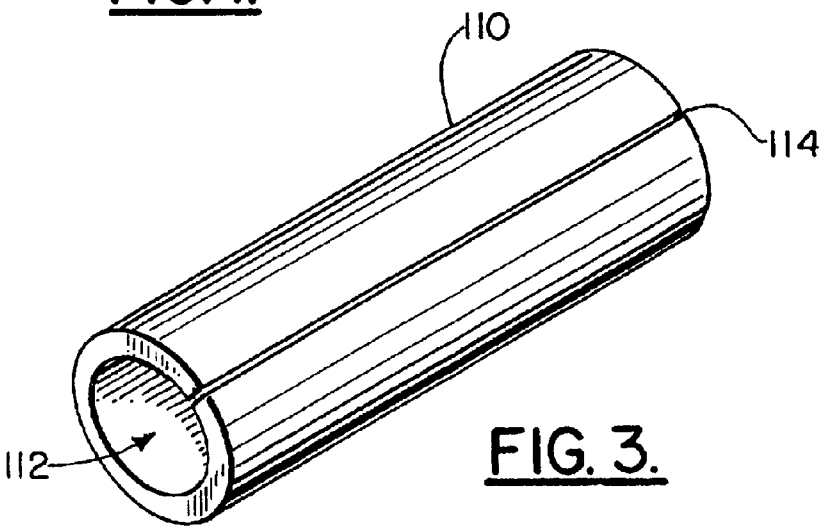
FIG. 3 is a perspective view of a shell made in accordance with the present invention.

Turning now to FIGS. 1–7 of the drawings, numeral 110 designates a tobacco product shell of the present invention.

The shell 110 is formed as a generally cylindrical hollow body with a central opening 112 extending along the shell's longitudinal axis. The shell 110 can be made in any desired length and with a predetermined diameter. A longitudinal slit or slit 114 extends through a wall of the shell body; the purpose of the slit or slit 114 will be explained in more detail hereinafter.

A form casing 116 is provided for the practice of the invention. The form casing 116 is formed from a substantially rigid material in a form of a cylinder of a predetermined length and outer diameter. The form casing 116 can be made either hollow, with a central opening 117, or as a solid body. It is desirable that the form casing 116 be substantially inflexible and strong enough to withstand forces applied to the form casing 116 when a shell 110 is rolled.

To form a shell 110, an operator selects the appropriate form casing 116 from a set of casings that may be available in the shop. Tobacco leaves are prepared for rolling by application of a small amount of moisture to the leaves in order to make them more pliable. The operator carefully wraps the tobacco leaves about the outer surface of the form casing 116, slightly compressing the leaves to cause them to adhere together.

The next step involves rolling of the form casing 116 with a tobacco leaf wrapped about it on a hard level surface, such a worktable. The steps of wrapping and rolling continue until the necessary layers of tobacco leaves have been rolled to form a shell 110 of a desired thickness.

It is known that wet tobacco leaves tend to adhere to each other. Therefore, subsequent application of moisture, in many cases, may not be necessary. Still, if the leaves become brittle and there exists a danger of breaking the shell 110, the operator applies moisture to the leaves to retain their pliability.

Once the shell 110 has been created, the operator allows the shell to remain wrapped around the form casing 116 until dry. Cutting through the wall of the shell 110 with a sharp knife or a razor then makes the slit 114. A finished shell 110 is then removed from the form casing 116 and can be wrapped either in cellophane or another similar type of outer wrapper.

To facilitate disengagement of the shell 110 from the form casing 116, an outer surface of the form casing 116 may be pre-coated with a non-stick material. In this manner, the danger of an operator damaging the shell 110 is minimized. The non-stick coating may be of a permanent type or applied immediately before wrapping of the tobacco leaves. It is important to select a coating material that would not leave an undesirable taste or odor on the tobacco leaves. A polytetrafluoroethylene (such as that sold under the trademark Teflon®) coating may serve well for this purpose.

The finished shells 110 can be packaged in conventional containers and sold directly to customers who desire to roll their own cigars, but do not have the required finger dexterity. An ultimate user will remove the shell 110 from its outer wrapper (not shown) and prying the shell 110 open by forcing the shell apart along the slit 114. The user will then fill the opening 112 with any desired blend of the favorite tobacco and seal the slit 114 by applying a small amount of moisture to the edges of the slit 114 and bringing the edges together. A small amount of pressure may be applied to the shell 110 to cause sealing of the slit 114. In this manner, a custom-tailored cigar is made, answering all requirements of a connoisseur as to the tobacco blend, size and length of a cigar.

If desired, a kit for roll-your-own tobacco products can be manufactured and sold through tobacconists and specialty shops. The kit would contain a set of form casings 116, an initial supply of tobacco wrapping leaves for the making of the shell 110 and a set of instructions. The user will be able to make individual shells in privacy, at the most convenient time for the user. In this way, the formed shells 110 will be freshest.

In the alternative, a special wrapping material may be used for making shells 110. This material is available on the market; it is made of homogenized tobacco paper that can be wrapped about form casing 116.

It is also possible to make form casings 116 disposable. With this method, shell 110 will remain wrapped about form casing 116 until such time as a smoker desires to make a cigar. Wrapped shell 110 is then peeled off form casing 116 and used in a conventional manner. The benefit of such a method is elimination of the danger of a shell collapsing during shipment.

Still another approach uses a substantially rigid core form casing 116 with a non-stick coating on the outer surface and a secondary form casing made of a material such as cardboard that is slipped over the first form casing. The tobacco leaves are wrapped about the secondary form casing to make a shell. A cellophane sleeve is slipped over the finished shell and the first inner form casing is removed. The shells wrapped about the secondary form casing are shipped for sale. In that case, the finished product would look similar to the view shown in FIG. 1, except that form casing 116 will be made of a material such as cardboard.

Another method of constructing a cigar includes a sheet of material containing tobacco material. The sheet of material can be for example tobacco leaves that have been formed into a sheet and/or laminated together.

The sheet of material is moistened with a liquid that can be, for example, water, alcohol, ethyl alcohol, propylene glycol, glycerin, or benzyl alcohol. This liquid is preferably flavor containing. The flavored liquid can include for example vanillian, ethyl vanillian, maltol, strawberry furanone, maple furanone, cyclotene, rum ether, honey keytone, pyruvic acid, a liquid that contains lactones, pyrazines, aromatic acids, or various alcohols. These flavored liquids thus provide for the end user a shaped tube with a flavor of, for example, vanilla, honey, berry, chocolate, cognac, peach, and/or champagne.

With the method of the present invention, the tube that is formed preferably has a generally cylindrical shape. The sheet of material can be a single layer or multiple layers and can be comprised entirely of tobacco leaves, or can be a combination of tobacco leaves and other combustible material. While not preferred, the sheet of material can omit tobacco entirely.

In FIGS. 4–7, a sheet of material 118 is shown that can be, for example, generally rectangular or square in shape. Other shapes for the sheet of material 118 can be provided such as, for example, triangular, trapezoidal, circular or oval. The sheet of material 118 preferably 4 includes tobacco, and preferably tobacco leaves. The sheet of material 118 preferably comprises a laminated composite of two layers, one inner layer 141 preferably made of homogenized tobacco material and the other outer layer 142 preferably made of tobacco leaf material, inner layer 141 and outer layer 142 preferably bonded together with cigar glue. Preferably, the outer layer 142 extends beyond the inner layer to provide for better adhesion of the edge 122 of sheet 118 to the outside of the cigar when rolled. The homogenized tobacco material of inner layer 141 can be reconstituted tobacco sheet material commercially available from Nuway of Connecticut. Outside layer 142 can be tobacco leaf material commercially available from Nuway of Connecticut.

Alternatively, inner layer 141 can be reconstituted tobacco binder material, and outer layer 142 can be reconstituted tobacco wrapper material. In the alternative, inner layer 141 can be 4 reconstituted tobacco binder material, and outer layer 142 can be tobacco leaves bonded thereto.

Figure 4:
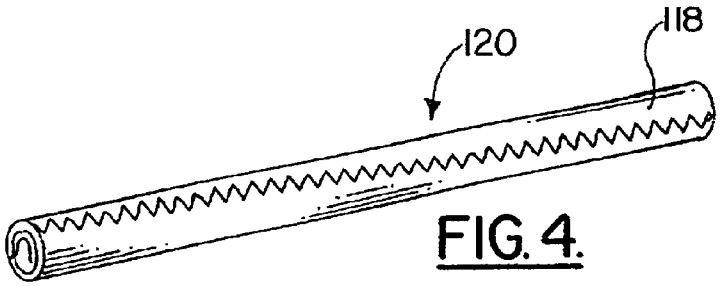
FIG. 4 is a perspective view of another embodiment of the apparatus of the present invention.
Figure 6:
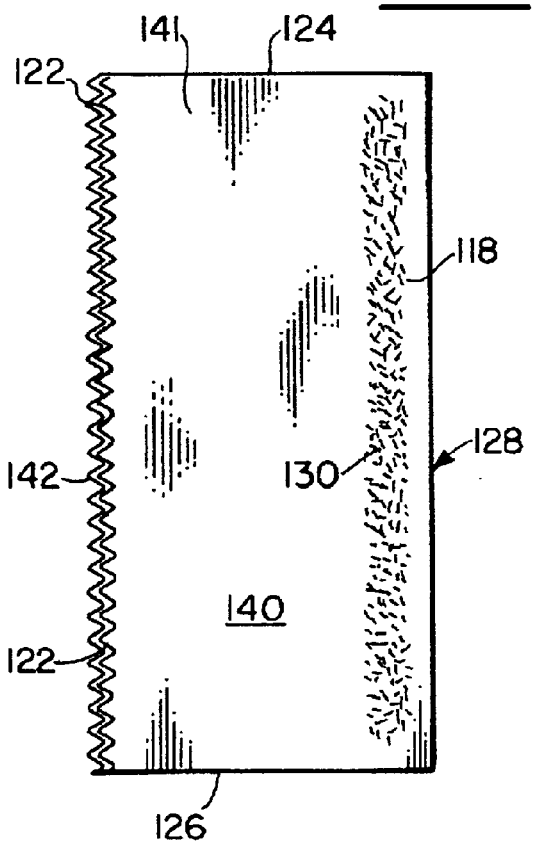
FIG. 6 is a plan view of the embodiment of FIG. 4 prior to rolling, illustrating the sheet material portion.

The sheet of material 118 is rolled to form a shaped tube 120 as shown in FIG. 4. Sheet of material 118 preferably has a serrated edge 122 that is generally opposite straight edge 128. A pair of spaced apart sides 124, 126 are provided as shown in FIG. 6. The sheet of material 118 provides a surface 140 to which selected tobacco filler material 130 can be added by a consumer/end user. The purpose of serrating edge 122 is to make the edge bond better. Instead of serrations, edge 122 could be otherwise frayed, or along edge 122 one could roughen the inner portion of the sheet 118 to enable the edge 122 to better bond to the outside of the cigar when rolled.

Figure 5:
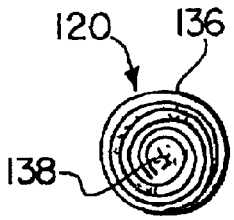
FIG. 5 is an end view of the embodiment of FIG. 4.

Sheet of material 118 can be a single layer, in which case it is preferably made of tobacco leaf material, though it can be made of homogenized tobacco material. Sheet of material 118 need not have a serrated edge, but can simply have a straight edge on each end. Sheet 11 can be wrapped in a spiral as shown in FIG. 5, such that the length of material sheet 118 (the distance from edge 128 to edge 122) is several times the diameter of the spiral wrap shown in FIGS. 4 and 5. This longitudinal spiral will have an open volume along its longitudinal axis between layers of sheet of material 118. This open volume may be partially filled with a tobacco filler material or may be unfilled.

As part of the method of the present invention, the sheet of material 118 is first rolled into a generally cylindrically shaped tube 120. The shaped tube 120 can be cylindrically shaped and can be a spiral wrap 136 (see FIGS. 4–5). As part of the method, the sheet of material 118 can be sprayed with a liquid that includes preferably flavor and then rolled into a generally cylindrically shaped tube 120. The sheet of material 118 can be rolled (see arrow 134) into the shaped tube 120 and then sprayed with a liquid material that includes flavoring.

Figure 7:
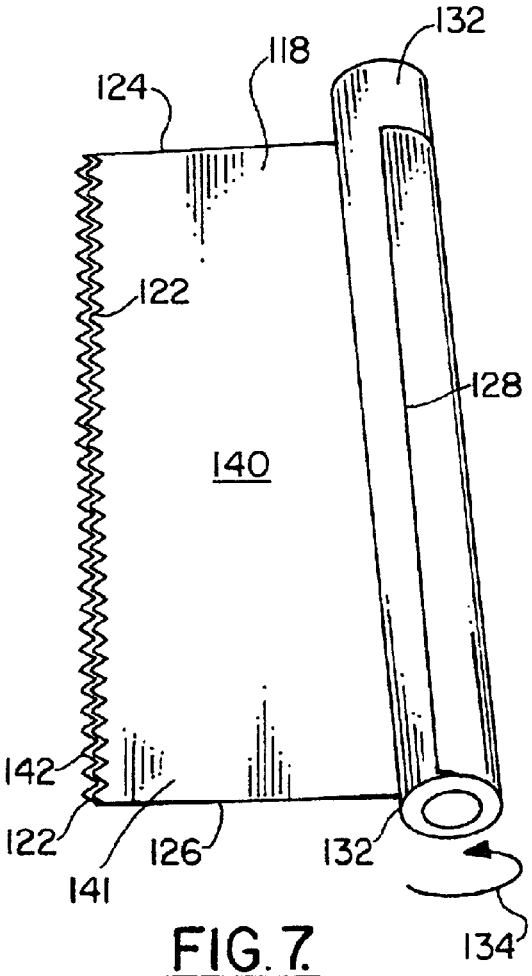
FIG. 7 is a schematic perspective view showing fabrication of the tube.

In FIG. 7, a cylindrical form roller 132 can be provided for rolling the sheet of material 118 into a cylindrically shaped, tube 120. The sheet of material 118 can simply be rolled without the use form roller 132 into a spiral wrap indicated as 136 in FIG. 5. The shaped tube 120 is allowed to dry somewhat but retains some moisture and flavor when it is packaged and shipped without any tobacco filler material (or with only a partial fill of tobacco material). In other words, the tube shaped shell 110 or 120 can be completely empty or partially filled. Therefore, the present invention enables consumers or end users to construct a cigar that is unique and personal by enabling the end user to add his or her own favorite tobacco to tube or shell bore 47, 117 or 138.

In FIG. 6, shaped tube 120 has been unrolled to a position exposing surface 140 and allowing tobacco filler material 130 to be added along edge 128. Because shaped tube 120 is pre-rolled into a cylinder (FIGS. 1–3) or pre-wrapped into spiral wrap 136 (FIG. 5), the sheet of material 118 has a "memory" and will attempt to again assume the cylinder shape of tube 120 or spiral wrap 136 after tobacco filler material 130 has been added to surface 140. Central bore 138 of shaped tube 120 thus can carry a tobacco filler material 130 that is added by a user. A slot or slit is formed in between the edges 122, 128 after tobacco filler material 130 is added because edges 122, 128 will come together at the slit due to the memory of the sheet of material 118.

Figure 8:
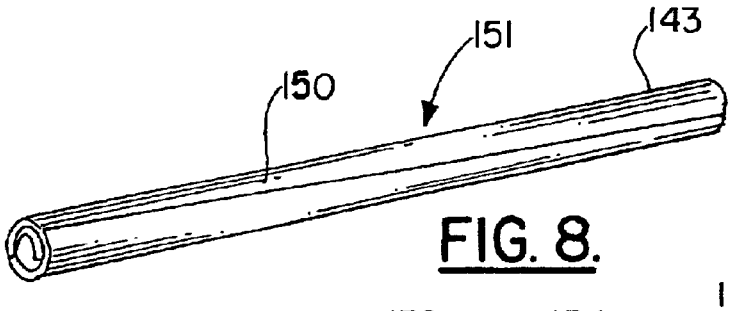
FIGS. 8, 9 and 10 are schematic views illustrating yet another alternate embodiment of the apparatus of the present invention.
Figure 9:
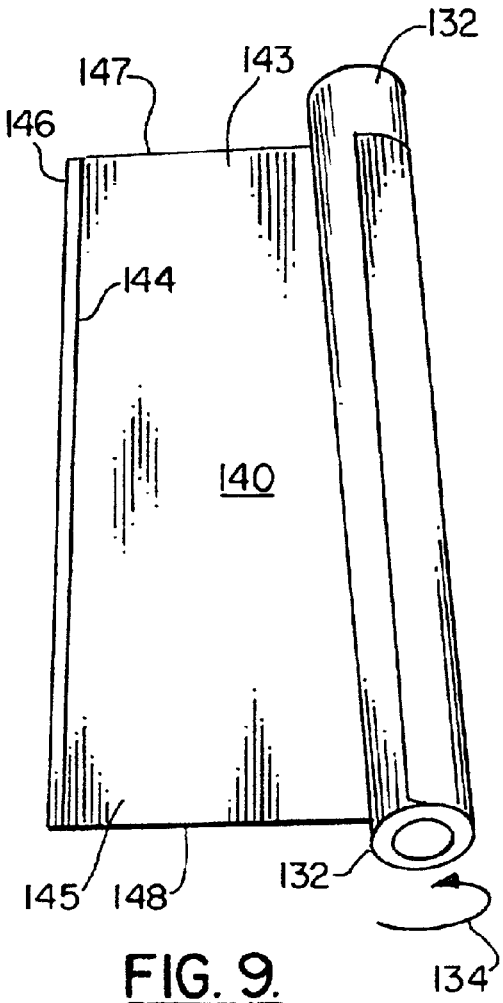

FIGS. 8 and 9 show a sheet of material 143 similar to sheet 118 except that it has a straight edge 144 instead of a serrated edge. Sheet of material 143 is preferably otherwise the same as sheet 118. The sheet of material 143 preferably comprises a laminated composite of two layers, one inner layer 145 made of homogenized tobacco material and the other outer layer 146 made of tobacco leaf material, bonded together with cigar glue. Preferably, the outer layer 146 extends beyond the inner layer 145 to provide for better adhesion of the edge 144 to the remaining portion of a custom rolled cigar. Sheet 143 includes sides 147 and 148. It includes a surface 140 for receiving tobacco filler material 130. It includes an edge 150. Sheet of material 143 can be wound into a spiral wrap 151 as shown in FIG. 8. Sheet of material 143 can also be packaged with cylindrical form roller 132, for example as shown in FIGS. 27 through 31.

Figure 10:
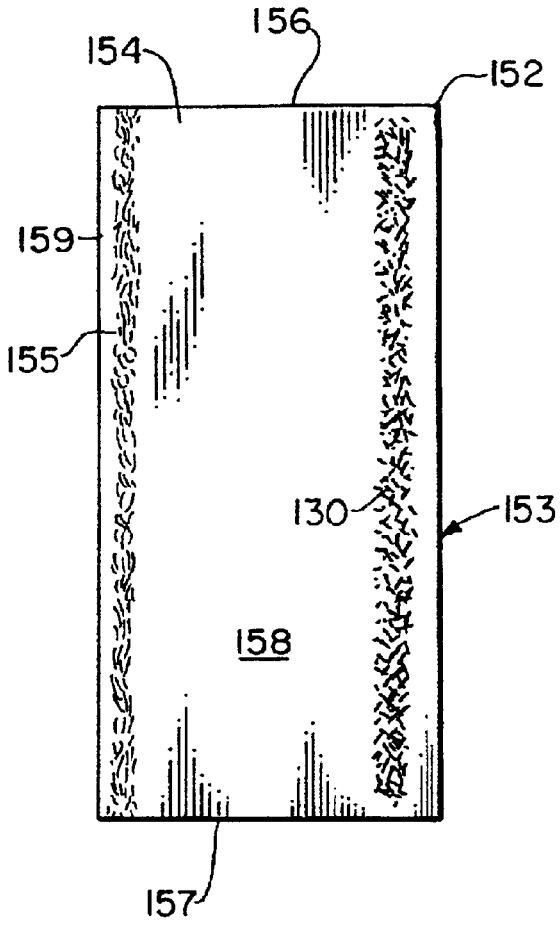

FIG. 10 shows a sheet of material 152 similar to sheet 118 except that it has a straight edge 153 instead of the serrated edge 122 of FIGS. 4–7 and is of a single layer of tobacco material. Sheet of material 152 is preferably otherwise the same as sheet 118. The sheet of material 152 preferably comprises a single layer 154 made of tobacco leaf material, though it could be made of homogenized tobacco material. Preferably, there is a roughened area 155 along edge 153 to provide for better adhesion of the edge 153 to the remaining portion of the custom rolled cigar. The roughened area 155 could be made by a rotating roughening wheel to fray the fibers of layer 154. Sheet 152 includes sides 156 and 157. It includes a surface 158 for receiving tobacco filler material. It includes a straight edge 159. Sheet of material 152 can be wound into a spiral wrap as shown in FIG. 8. Sheet of material 152 could be made into a spiral wrap by winding it upon a form roller such as 132, or it could be spiral wrapped without the use of a form roller.

Figures 11, 12, 13:
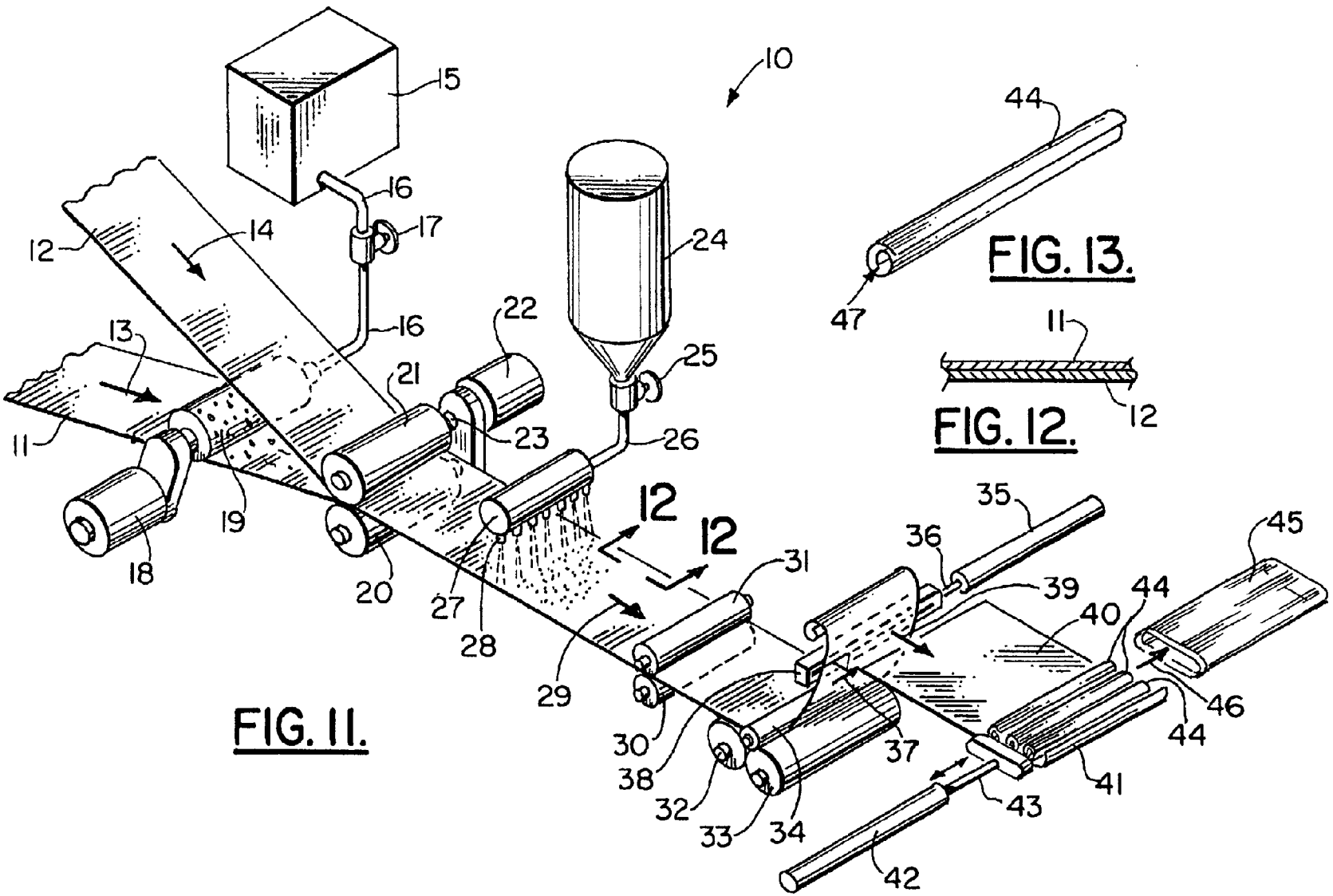
FIG. 11 is a perspective view illustrating a method of manufacturing the product of the present invention.
FIG. 12 is a sectional view taken along lines 12—12 of FIG. 11.
FIG. 13 is a perspective view of a shaped tube that is formed using the method shown in FIG. 11.

FIGS. 11–13 show an alternate construction of the apparatus of the present invention and illustrating a method for manufacturing shaped tube 44 shown in FIG. 13. FIGS. 11–13 provide a cigar tube fabricating apparatus 10 that begins with a binder layer of material 11 and a wrapper layer of material 12. Arrows 13, 14 in FIG. 11 show schematically the travel of layers 11, 12 toward a perforated gluing roller 19. Layers 11, 12 are preferably tobacco material such as tobacco leaf material or reconstituted tobacco material that has been formed into sheet material. The layers 11, 12 are glued together at roller 19 and with the pair of rollers 20, 21.

A suitable glue or adhesive is contained in container 15. The contained glue product flows through flowline 16 to perforated gluing roller 19. The roller 19 can be powered with motor 18. Valve 17 can be used to regulate the amount of glue that is flowing through flowline 16 so that sufficient glue but not an excessive amount is applied to the interface between the layers 11, 12.

The rollers 20, 21 press the layers 11, 12 together with glue therebetween so that the combined layers 11, 12, as shown in FIG. 12, move toward the remaining part of the apparatus 10. The roller 20 can be an idler roller. The roller 21 is preferably a driven roller that is powered by motor 22 and its drive shaft 23.

A container 24 is provided for holding flavoring material, that is preferably in liquid form. The container 24 communicates with flowline 26 having valve 25. Manifold 27 is provided with a plurality of dispensing nozzles 28 that enable the flavoring material to drip upon the combined layers 11, 12. Arrow 29 indicates that the layers 11, 12 move toward additional rollers 30 and 31 before being curled by rollers 32, 33 and 34. The rollers 30 and 31 can be idler rollers.

The rollers 32, 33 are larger diameter rollers that engage the bottom or binder layer 11 portion of the combined sheet. The roller 34 is a smaller diameter roller that engages the upper layer 12, namely the wrapper layer. This configuration of rollers 32, 33, 34 causes the combined layers 11, 12 to curl as shown in FIG. 11. A knife blade 37 is used to cut through the combined layers 11, 12 to produce a shaped tube or shell 44 that is in a spiral shape as shown in FIG. 13. Tube 44 provides a longitudinal and preferably empty bore 47. This shaped tube or shell 44 can then be used by consumers or end users to make a cigar. The end users or consumers can add tobacco of their choosing to bore 47. It should be understood, however, that a small amount of tobacco fill material can be added to the bore 47 if desired before tube 44 is placed in container 45.

The knife blade 37 is moved in a transverse direction using cylinder or piston 35 with pushrod 36. The knife blade 37 is connected to the pushrod 36. A knife blade guide 38 ensures that the blade 37 travels in a clean transverse path that is basically 90 degrees with respect to the direction of travel indicated by arrow 29. Arrow 39 indicates schematically that the cut shaped tube 44 falls upon the conveyor plate 40 and rolls toward stop 41. Stop 41 is simply a curved portion of plate 40 that catches the shaped tubes 44 as they are formed and cut. Piston 42 is provided with pushrod 43 for transferring a selected number such as 1, 2, 3 or more shaped tubes 44 into a package or container 45. It should be understood that the package or container 45 is preferably of a material that enables the end user or consumer to see the contained shaped tubes 44. For example, a cellophane material can be used in the construction of a suitably configured container 45. Arrow 46 in FIG. 11 schematically indicates the insertion of one or more shaped tubes 44 into container or package 45.

Figure 16:
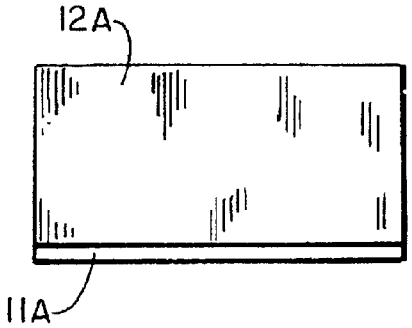
FIG. 16 is a schematic view illustrating the product that is formed in FIGS. 14 and 15.
Figure 14:
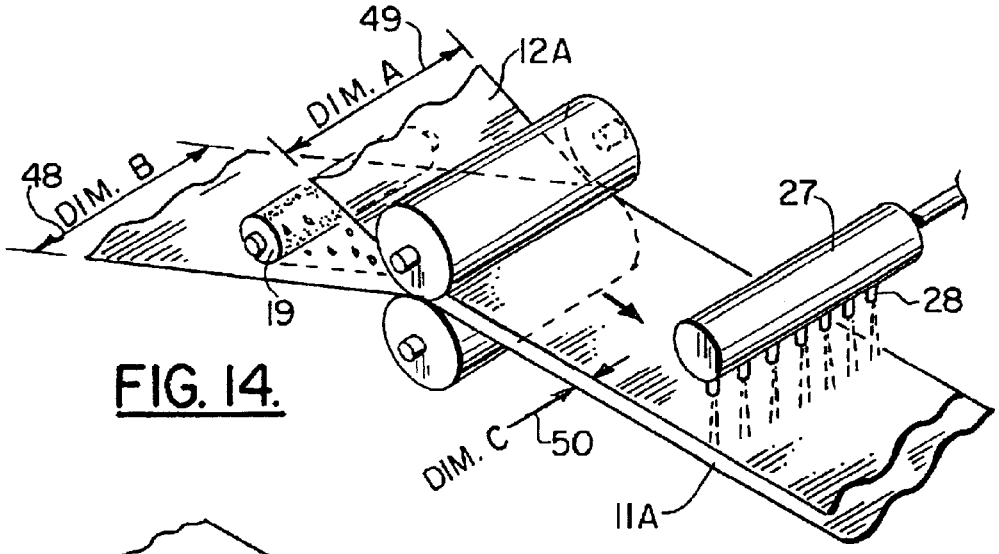
FIGS. 14–15 are perspective views of another embodiment of the apparatus of the present invention and showing an alternate method of the present invention.
Figure 15:
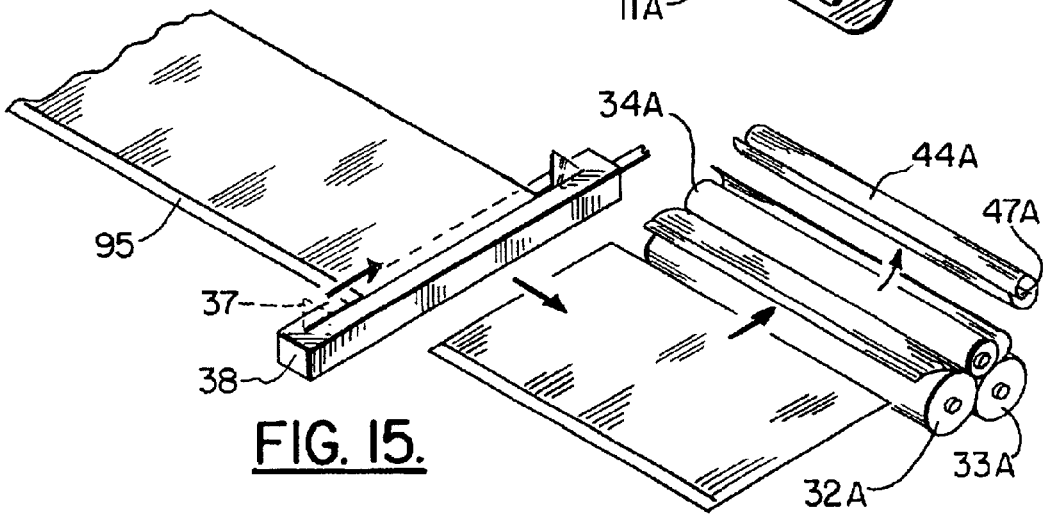

In FIGS. 14–16, a method that is similar to the method shown in FIGS. 11–13 is illustrated. However, in FIGS. 14–16, one of the layers 11A is wider than the other layer 12A. The lower, binder layer 11A is of a wider dimension indicated by arrow 48. The upper or wrapper layer 12A is of a slightly smaller width, indicated schematically by the arrow 49 in FIG. 14. This difference in widths produces a small strip of material indicated by dimension arrow 50 in FIG. 14 that is basically a single layer portion. Once the shaped tubes 44 are wrapped using the plurality of rollers 32A, 33A, 34A, a single layer portion of layer 11A extends the dimension line 50 beyond the width dimension 49 of upper layer 12A. That strip of material 95 is shown in FIG. 15. Strip 95 presents an edge that can be moistened to help close tube 44A after a selected volume of a user's tobacco fill material has been added to bore 47.

Figure 17:
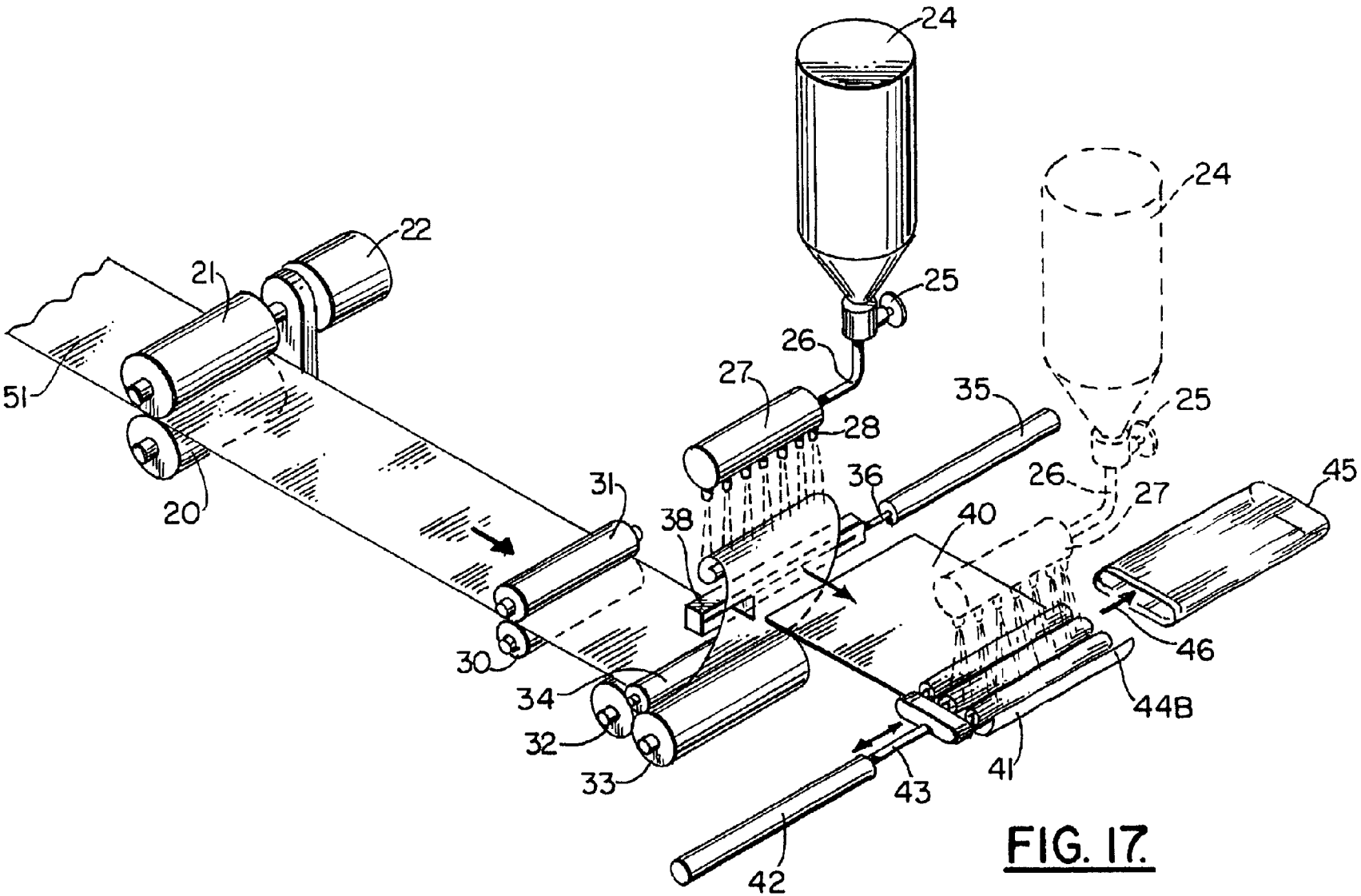
FIG. 17 is a perspective view of yet another embodiment of the method and apparatus of the present invention.

FIG. 17 shows an alternate construction of the apparatus that can be used for manufacturing shaped tubes. In FIG. 17, the same general components used in FIGS. 11–16 are provided. The provided layer of material 51 in FIG. 17 is of a single layer as opposed to the two layers shown in FIGS. 11–16. The shaped tube formed of a single layer is designated by the numeral 44B in FIG. 17.

Figure 18:
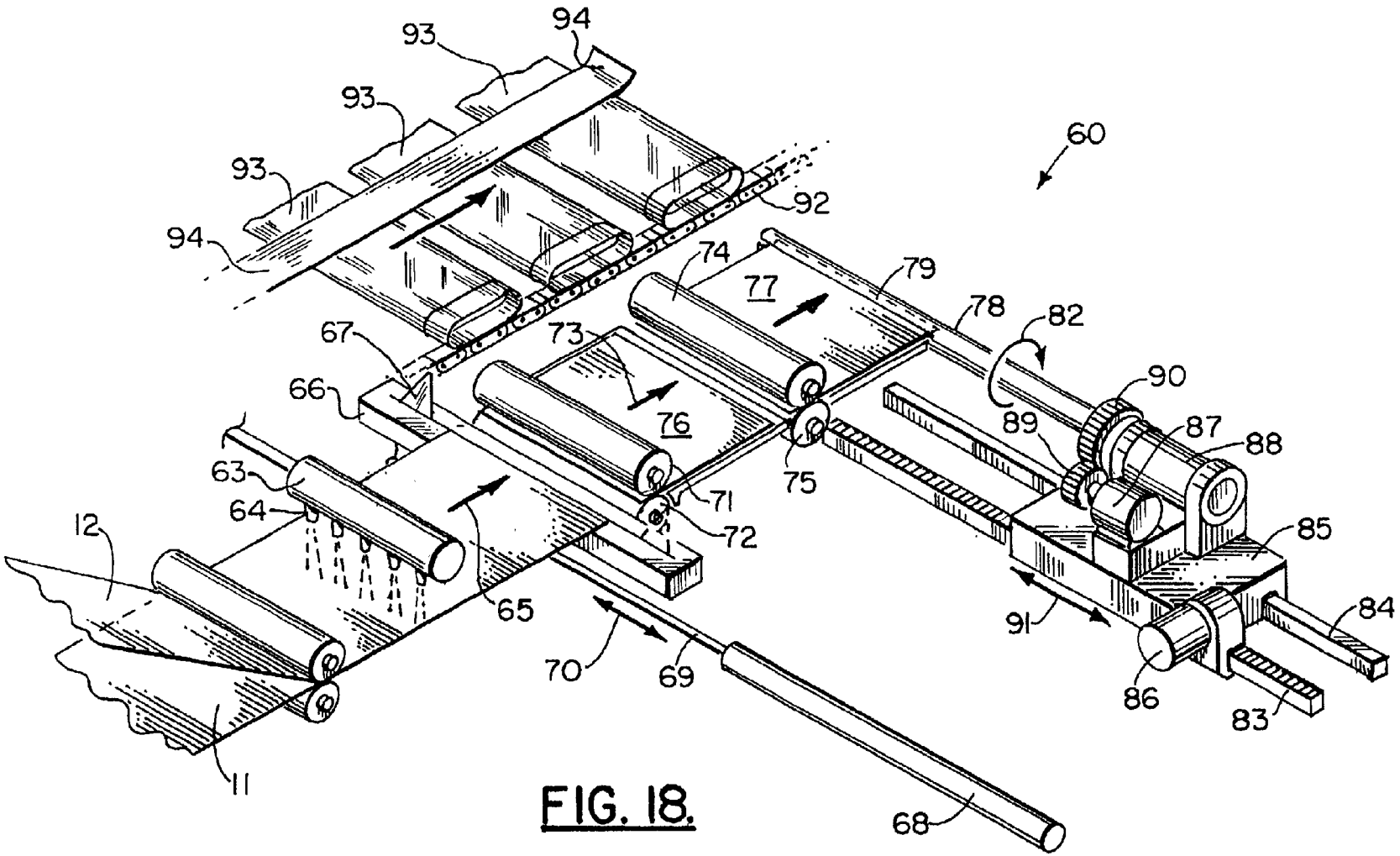
FIG. 18 is a partial perspective view of yet another embodiment of the apparatus and method of the present invention.

In FIGS. 18–24, yet another embodiment of the apparatus of the present invention is shown for forming shaped tubes, that apparatus being designated in FIG. 18 by the numeral 60. Cigar tube fabricating apparatus 60 includes a pair of rollers 61, 62 that receive layers of material 11, 12 as with the earlier described embodiments. Further, adhesive can be applied to the layers 11, 12 for adhering them together as was shown and described with respect to FIG. 11, that portion of the apparatus not being shown in FIG. 18 for purposes of clarity.

A manifold 63 can be provided with dispensing nozzle 64 for adding flavoring to the combined layers 11, 12. Arrow 65 in FIG. 18 indicates the direction of travel of the combined sheets 11, 12. A knife blade 67 having guide 66, pushrod 69 and piston 68 can be provided for cutting the combined sheets 11, 12 and forming cut sections 76, 77. The knife blade guide 66 ensures that the cuts will be basically 90 degree cuts with respect to the direction of travel 65. Arrow 70 schematically indicates the transverse movement of the knife blade 67 during use.

Figure 20:
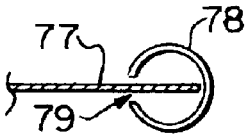
FIG. 20 is a schematic view taken along lines 20—20 of FIG. 22.
Figure 21:
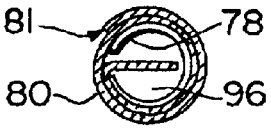
FIG. 21 is a schematic view taken along lines 21—21 of FIG. 23.
Figure 22:
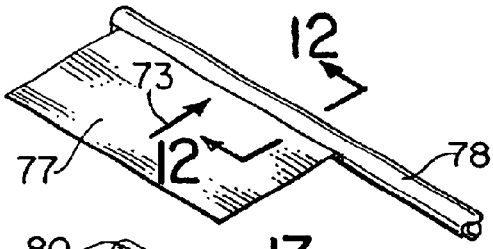
FIG. 22 is a fragmentary perspective view illustrating the method of the present invention that is shown in FIG. 18 and showing insertion of a sheet of material into the slit of the tube.
Figure 23:
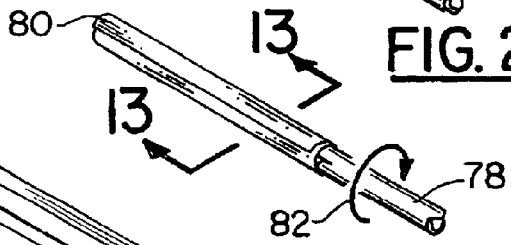
FIG. 23 is a partial perspective view showing the method of FIG. 18 and particularly the step of wrapping the sheet of material about the slit tube.
Figure 24:
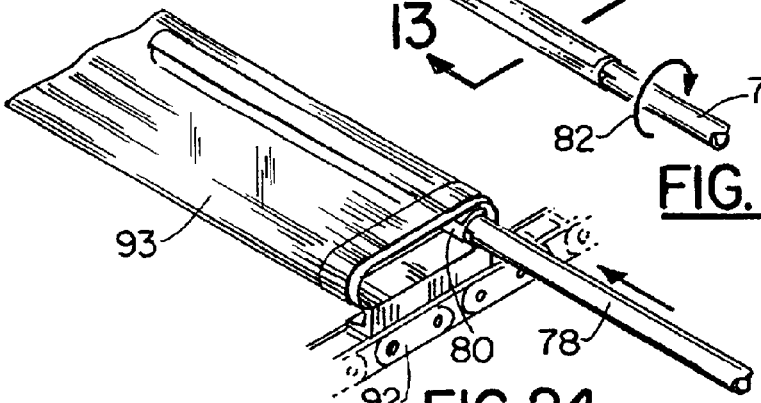
FIG. 24 is a partial perspective view of the method of FIG. 18 illustrating placement of a roll-shaped tube into a package using the slit tube.
Figure 19:
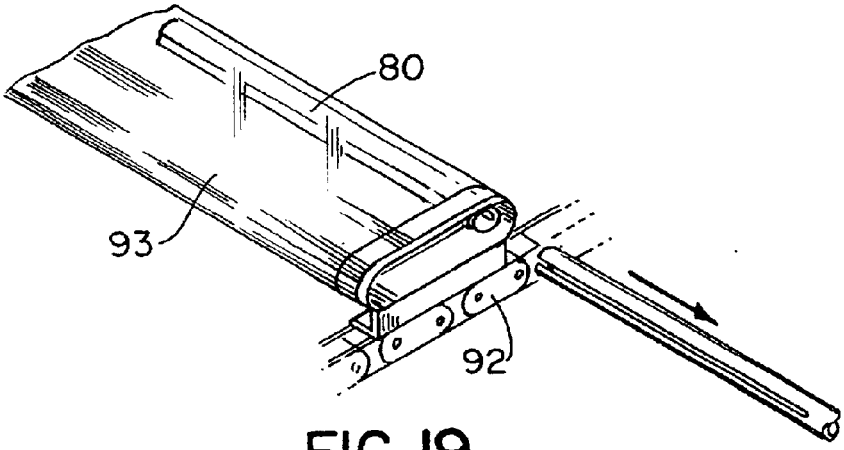
FIG. 19 is a partial perspective view illustrating the method of FIG. 18.

An upper roller 71 and a lower roller 72 can be driven rollers that advance each cut sheet 76, 77 toward rollers 74, 75 and then to slit tube 78. Arrow 73 indicates schematically the travel of a cut sheet 77 from the pair of rollers 71, 72 to the pair of rollers 74, 75. Each cut sheet 76, 77 feeds into slit 79 of slit tube 78. As shown in FIGS. 20 and 21, a cut sheet 77 inserts through slit 79 of slit tube 78. The slit tube 78 is then rotated in the direction of arrow 82 producing a shaped tube 80 that is wrapped about the slit tube 78 as shown in FIG. 21. The edge 81 shown in FIG. 21 provides an edge that can be opened by end users or consumers when they want to add a selected tobacco fill material to the bore 96 of shaped tube 80.

For inserting each shaped tube 80 into a package or wrapper 93, a pair of tracks 83, 84 are provided that support a carriage 85, as depicted in FIG. 18. Motor 86 provides a pinion gear that engages toothed track 83 and teeth on the upper surface thereof. The motor 86 is a reversible motor that enables the carriage 85 to be moved toward packages 93 or away from packages 93. Motor 87 is the motor that generates rotation for wrapping each cut sheet such as 77 about slit tube 78. The motor drive 87 has a gear 89 that engages gear 90 of transmission 88. Transmission 88 produces a desired slower rotation of tube 78 during a wrapping operation as shown in FIGS. 20 and 21. Arrow 91 indicates schematically the fore and aft travel of carriage 85. When the carriage 85 moves towards packages 93, the slit tube inserts a shaped tube 80 into a package 93. Pressure plate 94 applies enough friction to hold shaped tube 80 inside the package 93 so that when the carriage 85 returns to the position shown in FIG. 18, the shaped tube 80 slips off the end of the slit tube 78 and remains with the package or wrapper 93. A conveyor 92 can be provided for conveying a sequence of packages 93 toward the shaped tube 80 so that the delivery of shaped tubes 80 to the packages 93 is automated.

Figure 25:
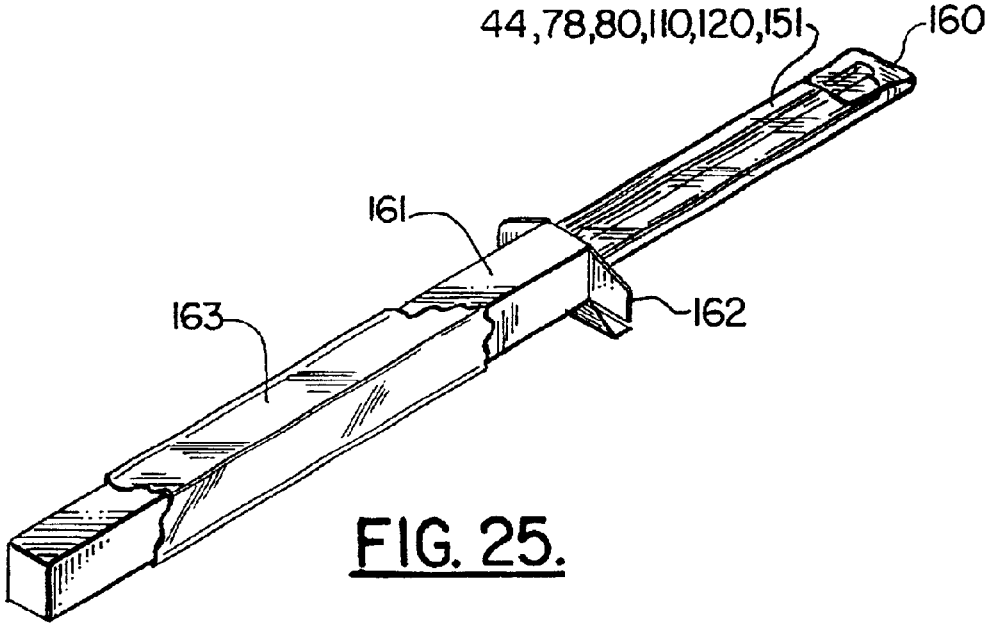
FIG. 25 is a perspective, partially cross-sectional view of a single shell in a wrapper and boxed with the shell partially pulled from the box and the box itself being wrapped.

The shells can be packaged in any appropriate manner. FIGS. 25 through 31 show various examples of packaging. FIG. 25 is a perspective, partial cross-sectional view of a single shell in a wrapper being boxed with the shell partially pulled from the box and the box itself being wrapped. This figure shows packaging that can be used for any shell embodiment disclosed in this application including shaped tube 44, slit tube 78, shaped tube 80, shell 110, shaped tube 120, spiral wrap 136, and spiral wrap 151; all of which embodiments will generically be referred to as a shell. The shell is shown covered in wrapper 160 which are both enclosed in box 161. Box 161 can itself be covered by wrapper 163. Flap 162 encases shell and wrapper 160 in box 161.

Figure 26:
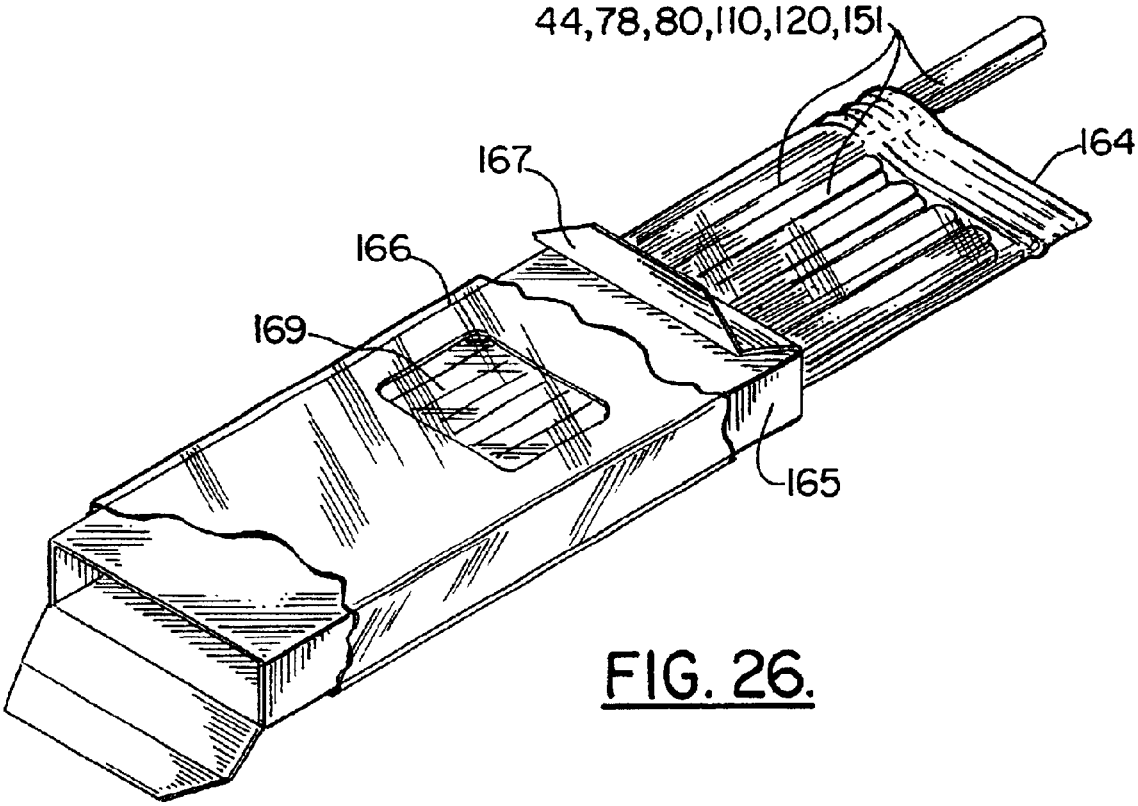
FIG. 26 is a perspective, partially cross-sectional view of multiple shells in a single zip-wrapper and boxed with the zip-wrapper partially pulled from the box with one shell partially pulled from the zip wrapper and the box itself being wrapped.

FIG. 26 is a perspective, partial cross-sectional view of multiple shells in a single zip-wrapper all of which being boxed and with the zip-wrapper partially pulled from the box with one shell partially pulled from the zip wrapper and the box itself being wrapped. This figure also shows packaging that can be used for any shell embodiment disclosed in this application including shaped tube 44, slit tube 78, shaped tube 80, shell 110, shaped tube 120, spiral wrap 136, and spiral wrap 151. The shells and zip-wrapper 164 can be enclosed in box 165. Box 165 can itself be covered by wrapper 166 and include window 169 for viewing the shells. Flaps 167, 168 close respective ends of box 165.

Figures 27, 28, 29, 30:
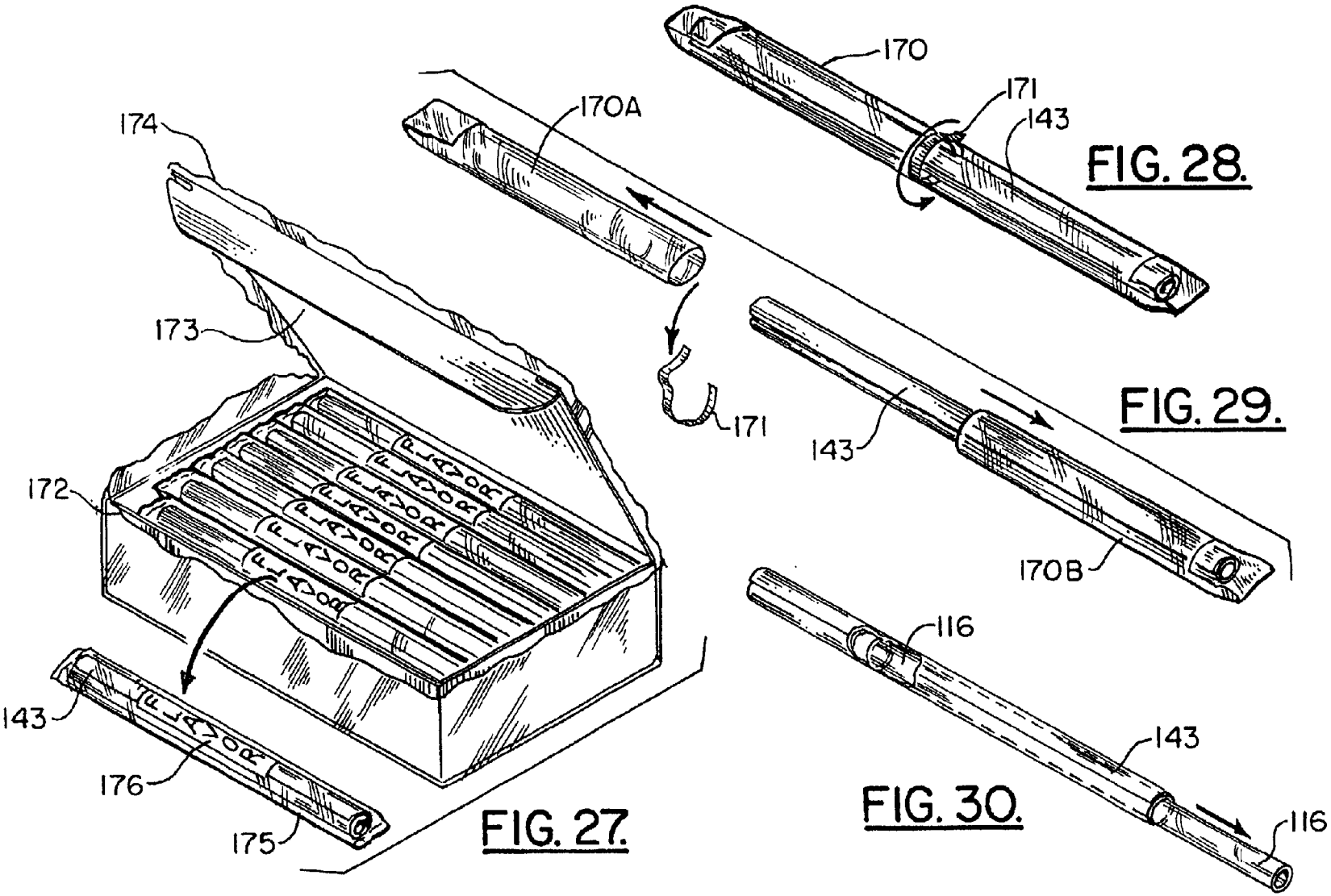
FIG. 27 is a perspective view of multiple shells individually wrapped and placed in a single carton opening at the top.
FIG. 28 shows a perspective view of an embodiment showing a shell packaged in wrapper with a pull string to open the wrapper.
FIG. 29 is an exploded view of the embodiment in FIG. 28.
FIG. 30 is a partial sectional view of the shell in FIG. 28 with the form casing partially removed.

FIG. 27 is a perspective view of multiple shells individually wrapped and placed in a sing carton 172 opening at the top through lid 173. The shells are individually packaged in wrapper 175 and wrapper 175 can have indicia 176 which provides consumers with information concerning the shell, such as flavoring or other information. Carton 172 can itself be covered by wrapper 174.

FIGS. 28 through 30 show an embodiment of shell 143 packaged in wrapper 170. Wrapper 170 includes pull 171 which facilitates separation of wrapper portions 170A and 170B. Removing either wrapper portion provides access to shell 143. FIGS. 27 through 30 show shell 143 packaged with form casing 116 which embodiment resists bending or folding of shell 143 before use by consumers.

Figure 31:
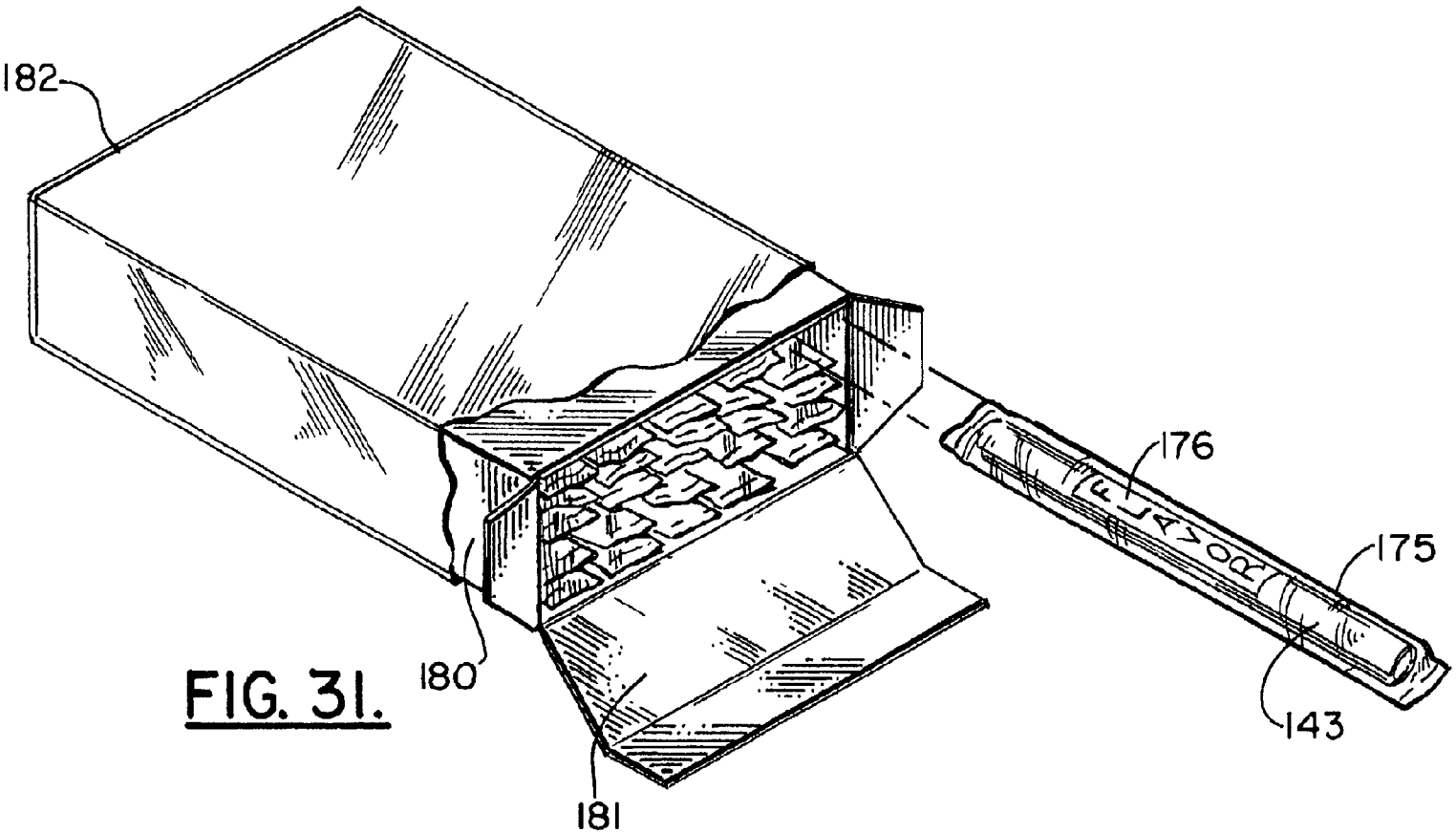
FIG. 31 is a perspective view of multiple shells individually wrapped and placed in a single carton opening at the side.

FIG. 31 is a perspective view of multiple shells individually wrapped and placed in a single carton 180 opening at the side through lid 181. The shells 143 are individually packaged in wrapper 175 and wrapper 175 can include indicia 176 which provides consumers with information concerning the shell, such as flavoring or other information. Carton 180 can itself be covered by wrapper 182.

Those skilled in the art will understand that various materials for wrapping can be used to enclosed the tubes or shells. These include, but are not limited to, Low & High Density Polyethylene with EVA additive, Linear Low Density Poly, Polypropylene, Orientated Polypropylene, Cast Polypropylene, PVC, Polyester, Vaper Barrier packaging, Moisture Barrier packaging, Laminated packaging, Shrink film, Stretch Film, Foil Films (which can be translucent or opaque), Metalized Film, Cellophane, and Polyethylene Terephthalat. In addition to an "EVA" additive a barrier foil lamination can be used being either coated or metallized. The packaging of the present invention, whether plastic, aluminum, or glass, keeps moisture in or dramatically slows down moisture loss from the tubes or shells. It is preferable that the wrapping material have adequate moisture resistant properties so that the tubes or shells do not dry out before use by consumers.

Beta cyclodextrine (BCD) can be added to homogenized tobacco paper by adding it to the slush to make the homogenized paper. This is so because the BCD powder ignites at about 450 degrees F. and the homogenized tobacco paper only reaches about 180 degrees F. during processing. Other methods of adding BCD to the homogenized tobacco paper could also be used. The homogenized tobacco paper with BCD powder therein can be used to make the tobacco shells of the present invention.

PARTS LIST

| PART NO | DESCRIPTION |
|---|---|
| 10 | cigar tube fabricating apparatus |
| 10A | cigar tube fabricating apparatus |
| 11 | binder layer |
| 11A | binder layer |
| 12 | wrapper layer |

-continued

PARTS LIST

| PART NO | DESCRIPTION |
|---|---|
| 12A | wrapper layer |
| 13 | arrow |
| 14 | arrow |
| 15 | container |
| 16 | flowline |
| 17 | valve |
| 18 | motor |
| 19 | perforated gluing roller |
| 20 | idler roller |
| 21 | drive roller |
| 22 | motor |
| 23 | drive shaft |
| 24 | container |
| 25 | valve |
| 26 | flowline |
| 27 | manifold |
| 28 | dispensing nozzle |
| 29 | arrow |
| 30 | idler roller |
| 31 | idler roller |
| 32 | large roller |
| 32A | large roller |
| 33 | large roller |
| 33A | large roller |
| 34 | small roller |
| 34A | small roller |
| 35 | piston |
| 36 | pushrod |
| 37 | knife blade |
| 38 | knife blade guide |
| 39 | arrow |
| 40 | conveyor plate |
| 41 | stop |
| 42 | piston |
| 43 | pushrod |
| 44 | shaped tube |
| 44A | shaped tube |
| 44B | shaped tube |
| 45 | container |
| 46 | arrow |
| 47 | longitudinal bore |
| 48 | dimension arrow |
| 49 | dimension arrow |
| 50 | dimension arrow |
| 51 | layer of material |
| 60 | cigar tube fabricating apparatus |
| 61 | roller |
| 62 | roller |
| 63 | manifold |
| 64 | dispensing nozzle |
| 65 | direction of travel |
| 66 | knife blade guide |
| 67 | knife blade |
| 68 | piston |
| 69 | pushrod |
| 70 | arrow |
| 71 | upper roller |
| 72 | lower roller |
| 73 | arrow |
| 74 | roller |
| 75 | roller |
| 76 | cut section |
| 77 | cut section |
| 78 | slit tube |
| 79 | slit |
| 80 | shaped tube |
| 81 | edge |
| 82 | arrow |
| 83 | toothed track |
| 84 | track |
| 85 | carriage |
| 86 | motor |
| 87 | motor |
| 88 | transmission |
| 89 | gear |

-continued

PARTS LIST

| PART NO | DESCRIPTION |
|---|---|
| 90 | gear |
| 91 | arrow |
| 92 | conveyor |
| 93 | package |
| 94 | pressure plate |
| 95 | strip of material |
| 96 | bore |
| 110 | shell |
| 112 | central opening |
| 114 | slit or slot |
| 116 | form casing |
| 117 | central opening |
| 118 | sheet of material |
| 120 | shaped tube |
| 122 | edge |
| 124 | side |
| 126 | side |
| 128 | edge |
| 130 | tobacco filler material |
| 132 | cylindrical form roller |
| 134 | arrow |
| 136 | spiral wrap |
| 138 | central bore |
| 140 | flat surface |
| 141 | inner layer |
| 142 | outer layer |
| 143 | sheet of material |
| 144 | straight edge |
| 145 | inner layer |
| 146 | outer layer |
| 147 | side |
| 148 | side |
| 150 | edge |
| 151 | spiral wrap |
| 152 | sheet of material |
| 153 | edge |
| 154 | single layer |
| 155 | roughened area |
| 156 | side |
| 157 | side |
| 158 | surface |
| 159 | edge |
| 160 | wrapper |
| 161 | box (e.g., paperboard) |
| 162 | flap |
| 163 | wrapper |
| 164 | zip-wrapper |
| 165 | box (e.g., paperboard) |
| 166 | wrapper |
| 167 | flap |
| 168 | flap |
| 169 | window |
| 170 | wrapper |
| 171 | pull |
| 172 | carton (open top) |
| 173 | lid |
| 174 | wrapper |
| 175 | wrapper |
| 176 | printing |
| 180 | carton (side open) |
| 181 | lid |
| 182 | wrapper |

Many changes and modifications can be made in the present invention without departing from the spirit thereof. I, therefore, pray that my rights to the present invention will be limited only by the scope of the appended claims.

What is claimed is:

1. A tobacco product, comprising:

(a) a sheet of tobacco-containing material that is flavored with a liquid additive that provide an elevated moisture content to the sheet of material;

(b) a longitudinal bore defined when the sheet is formed into a hollow tube;

(c) the longitudinal bore being not completely filled with a tobacco filler product; and (d) a package of such dimensions to maintain the sheet in the formed hollow tube configuration until removed from the package to thereby enable a consumer to unroll the hollow tube after removal from the package and then fill the bore with the user's selected tobacco material; and (c) wherein said elevated moisture content inhibits breaking of the tube when the tube is unrolled by a consumer.

2. The tobacco product of claim 1, wherein the bore is completely unfilled.

3. The tobacco product of claim 1, wherein the package has an opening between opposing walls which prevents the sheet from unrolling until removed from the package to insert tobacco fill material into the tube.

4. A tobacco product, comprising:

(a) a sheet of tobacco-containing material that is flavored with a liquid additive that provides an elevated moisture content to the sheet of material;

(b) a lube for receiving the sheet of material there around;

(c) a longitudinal bore formed in the material when the sheet is wrapped around the tube; and (d) a package of such dimensions for receiving the wrapped sheet of material wherein the package maintains the sheet in the wrapped configuration until the sheet and tube are removed from the package to be filled with a tobacco fill material.

5. A tobacco product, comprising:

(a) a shell of material containing in part tobacco and that is flavored with a liquid additive that provides an elevated moisture content to the sheet of material;

(b) a tube for wrapping the shell of material there around to define a cigar shape; and (c) a wrapper receiving and packaging the cigar shaped shell, the wrapper maintaining the shell in the cigar shape until the tube is removed from the package, enabling a user unroll the shell and to fill the shell with tobacco; and (d) wherein said elevated moisture content inhibits breaking of the tube when the lube is unrolled.

6. A shell for assembling custom-made rolls of tobacco for smoking, comprising:

(a) a sheet of combustible material which has not been part of a previously assembled cigar or cigarette, and that has been flavored with a liquid additive that provides an elevated moisture content to the sheet of material;

(b) said sheet of material having at least two edges and a surface area located between said edges;

(c) said area having an inner surface and an outer surface;

(d) wherein the sheet has a tubular shape at rest;

(e) said edges being separable to provide access to the inner surface of the sheet of material for depositing thereon tobacco products to be smoked in the shell; and (f) wherein said elevated moisture content inhibits breaking of the tube when the tube is unrolled.

7. A device for preparing a tobacco product, comprising:

a hollow shell having a central opening longitudinally therethrough, said shell being formed from homogenized tobacco paper, the shell having a longitudinal slit in a side wall of the shell to allow placing of crushed tobacco into said central opening, wherein the shell is formed by wrapping the homogenized tobacco paper about a removable from casing; and wherein said shell is wrapped about a removable form casing, said form casing having an outside diameter, which is slightly smaller than the diameter of the central opening.

8. The device of claim 7, wherein said form casing is provided with a non-stick coating deposited on an outer surface of the form casing.

9. A device for preparing a tobacco product, comprising:

(a) a removable substantially cylindrical form casing;

(b) a shell body of homogenized tobacco material having a central opening extending longitudinally therethrough, said shell body being wrapped about said form casing;

(c) a longitudinal opening formed in a sidewall of the shell body to allow placing of crushed tobacco into said central after the form casing is removed from the shell body;

(d) wherein the shell is formed by wrapping the homogenized tobacco paper about the removable form casing; and (e) wherein said elevated moisture content inhibits breaking of the tube when the tube is unrolled.

10. The device of claim 9, wherein said central opening is adapted for receiving crushed tobacco after said form casing has been removed.

11. The invention of claim 9, wherein there are multiple layers of homogenized tobacco paper.

12. The device of claim 9 wherein the shell body is flavored with an additive.

13. The device of claim 9 wherein the additive is a liquid.

14. The device of claim 13 wherein the liquid includes a solvent.

15. The device of claim 13 wherein the liquid include in part, oil.

16. The device of claim 13 wherein the liquid include in part, propylene.

17. The device of claim 13 wherein the liquid include in part, glycerine.

18. The device of claim 13 wherein the liquid include in part, benzyl.

19. The device of claim 13 wherein the liquid is flavored with a flavor selected from the group of vanilla, honey, berry, chocolate, peach, champagne, cognac and menthol.

20. The device of claim 13 wherein the liquid includes a humectant.

21. The device of claim 12 wherein the additive includes botanical extract material.

22. A product including a cigar tube for holding an end user's tobacco fill material, comprising:

a) a cigar tube which comprises a sheet of material or tobacco leaves or homogenized tobacco paper flavored with a liquid additive that provides an elevated moisture content to the sheet of material, the sheet of material being rolled into a shaped tube that has a longitudinal bore, and edges that can be removed apart by the end user so that tobacco fill material can be added to the bore;

b) a wrapper, wherein the cigar tube is packaged in the wrapper, and the cigar tube remains rolled in said lube shape inside the wrapper, and the packaged cigar tube is not filled with tobacco to form a complete cigar; and (c) wherein said elevated moisture content inhibits breaking of the shaped tube when the edges are moved apart by the end user.

23. The product of claim 22 further comprising moisture in the sheet of material.

24. The product of claim 22 wherein the sheet is entirely comprised of tobacco material.

25. The product of claim 22 wherein the wrapper is of cellophane material.

26. The product of claim 22 wherein the wrapper is of a clear material.

27. The product of claim 22 wherein the wrapped, shaped tube does not contain any tobacco fill material.

28. The product of claim 22 wherein the tube is not formed by removing the combustible filler of an existing prefabricated cigar.

29. The product of claim 2 wherein multiple layers define the sheet of material.

30. A product including a cigar tube for holding an end user's tobacco fill material, comprising:

a) a cigar tube which comprises a sheet of material of tobacco leaves or homogenized tobacco paper flavored with a liquid additive that provides an elevated moisture content to the sheet of material, the sheet of material being rolled into a shaped tube that has a longitudinal bore, and edges that can be moved apart by the end user so that tobacco fill material can be added to the bore;

b) a wrapper, wherein the cigar tube is packaged in the wrapper, and the cigar tube remains rolled in said tube shape inside the wrapper after packaging; and (c) wherein said elevated moisture content inhibits breaking of the shaped tube when the edges are moved apart by the end user.

31. The product of claim 30 further comprising moisture in the sheet of material.

32. The product of claim 30 wherein the sheet is entirely comprised of tobacco material.

33. The product of claim 30 wherein the wrapper is of cellophane material.

34. The product of claim 30 wherein the wrapper is of a clear material.

35. The product of claim 30 wherein the wrapped, shaped tube does not contain any tobacco fill material.

36. The product of claim 30 wherein the tube is not formed by removing the combustible filler of an existing prefabricated cigar.

37. A product including a cigar tube for holding an end user's tobacco fill materiel, comprising:

a) a cigar tube which comprises a sheet of material of tobacco leaves or homogenized tobacco paper that are flavored with a liquid additive that provides an elevated moisture content to the sheet of material, the sheet of material being rolled that has a shaped tube that has a longitudinal bore, and edges that can be moved apart by the end user so that tobacco fill material can be added to the bore;

b) a wrapper, wherein the cigar tube is packaged in the wrapper, the wrapper has a clear portion for enabling a consumer to see the cigar tube, and the cigar tube remains rolled said the shape inside the wrapper; and (c) wherein said elevated moisture content inhibits breaking of the shaped tube when the edges are moved apart by the end user.

38. The product of claim 37 further comprising moisture in the sheet of material.

39. The product of claim 37 wherein the sheet is entirely comprised of tobacco material.

40. The product of claim 36 wherein the wrapper is of cellophane material.

41. The product of claim 37 wherein the wrapper is of a clear material.

42. The product of claim 37 wherein the wrapped, shaped tube does not contain any tobacco fill material.

43. The product of claim 37 wherein the tube is not formed by removing the combustible filler of an existing prefabricated cigar.

44. The product of claim 37 wherein multiple layers define the sheet of material.

* * * * *